US007552952B2

(12) United States Patent
Roesslinger

(10) Patent No.: US 7,552,952 B2
(45) Date of Patent: Jun. 30, 2009

(54) SYSTEM FOR DETECTION OF THE LOCKING STATES OF A MOTOR VEHICLE

(75) Inventor: Lionel Roesslinger, Creteil Cedex (FR)

(73) Assignee: Valeo Securite Habitacle, Creteil Cedex (FR)

( * ) Notice: Subject to any disclaimer, the term of this patent is extended or adjusted under 35 U.S.C. 154(b) by 86 days.

(21) Appl. No.: 10/569,670

(22) PCT Filed: Aug. 18, 2004

(86) PCT No.: PCT/EP2004/051822

§ 371 (c)(1),
(2), (4) Date: Feb. 27, 2006

(87) PCT Pub. No.: WO2005/021901

PCT Pub. Date: Mar. 10, 2005

(65) Prior Publication Data

US 2006/0213242 A1 Sep. 28, 2006

(30) Foreign Application Priority Data

Aug. 28, 2003 (FR) ..... 03 10266

(51) Int. Cl.
*E05C 3/06* (2006.01)

(52) U.S. Cl. ..... 292/201; 70/264; 318/466

(58) Field of Classification Search ..... 318/466; 292/201; 70/257, 264
See application file for complete search history.

(56) References Cited

U.S. PATENT DOCUMENTS 4,502,718 A * 3/1985 Sasaki et al. ..... 292/336.3
4,762,348 A * 8/1988 Matsumoto ..... 292/201
5,125,702 A * 6/1992 Fukumoto et al. ..... 285/337

(Continued)

FOREIGN PATENT DOCUMENTS

| | | |
|---|---|---|
| DE | 42 22 018 | 6/1993 |
| EP | 0 964 119 | 12/1999 |
| EP | 1 008 711 | 6/2000 |
| FR | 2 778 939 | 11/1999 |

OTHER PUBLICATIONS

International Search Report for PCT/EP2004/051822 dated May 13, 2005 (3 pages).

(Continued)

*Primary Examiner*—Lincoln Donovan
*Assistant Examiner*—Antony M Paul
(74) *Attorney, Agent, or Firm*—Osha • Liang LLP

(57) ABSTRACT

A system for the detection of at least an open state of an opening of a motor vehicle and two other states of a lock of said opening, called a first state and a second state, includes two switching devices associated with the opening and the lock. One of the two switching devices includes a first contact breaker with a normally open or normally closed position detecting at least the open state of the opening. The two switching devices are connected to a ground cable. The first contact breaker detects the first state and is connected to a first information cable. The other of the two switching devices includes a second contact breaker with a position normally open or normally closed detecting two states and is connected to a second information cable. Of the two states, one is common with the state detected by the first contact breaker. The first and second information cables are connected to analytical means.

15 Claims, 5 Drawing Sheets

U.S. PATENT DOCUMENTS

| | | | | |
|---|---|---|---|---|
| 5,656,899 | A * | 8/1997 | Kuroda | 318/283 |
| 5,785,364 | A | 7/1998 | Armbruster | |
| 5,938,252 | A * | 8/1999 | Uemura et al. | 292/201 |
| 6,065,316 | A * | 5/2000 | Sato et al. | 70/264 |
| 6,278,252 | B1 * | 8/2001 | Kachouh | 318/466 |
| 6,698,804 | B2 * | 3/2004 | Shiota et al. | 292/201 |
| 6,779,372 | B2 * | 8/2004 | Arlt et al. | 70/237 |
| 6,948,745 | B2 * | 9/2005 | Chevalier | 292/201 |

OTHER PUBLICATIONS esp@cenet Abstract for FR2778939 dated Nov. 26, 1999 (1 page).
esp@cenet Abstract for EP1008711 dated Jun. 14, 2000 (1 page).
esp@cenet Abstract for EP0964119 dated Dec. 15, 1999 (1 page).
esp@cenet Abstract for DE4222018 dated Jun. 17, 1993 (1 page).

* cited by examiner

[Fig. 005]
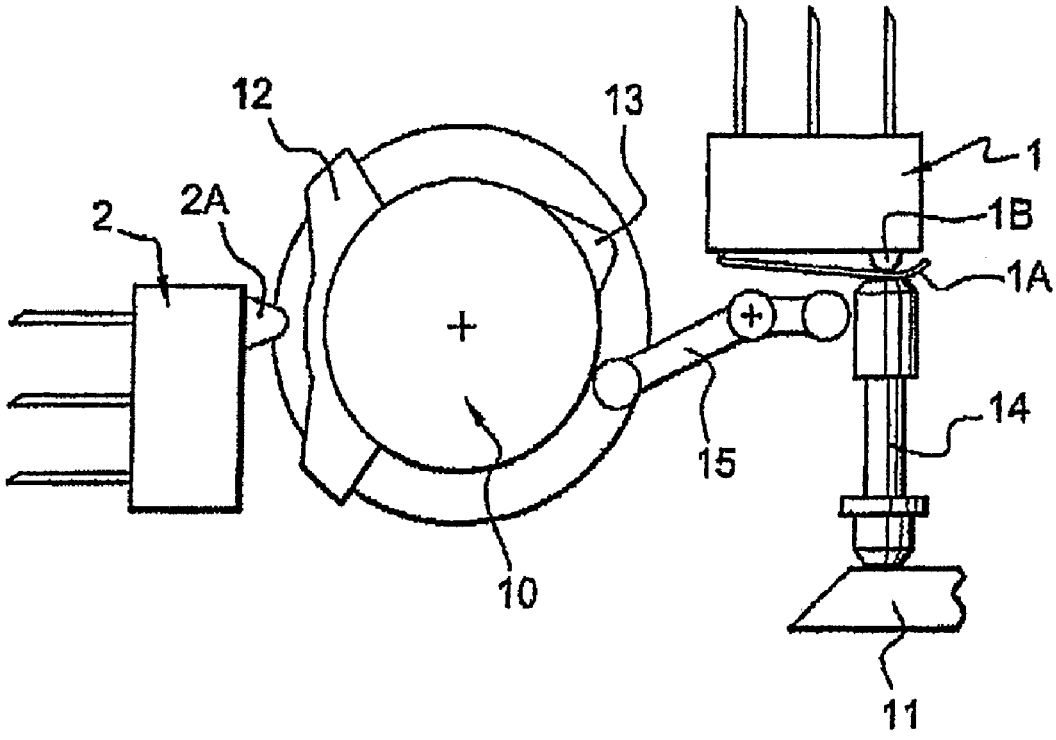

[Fig. 009]
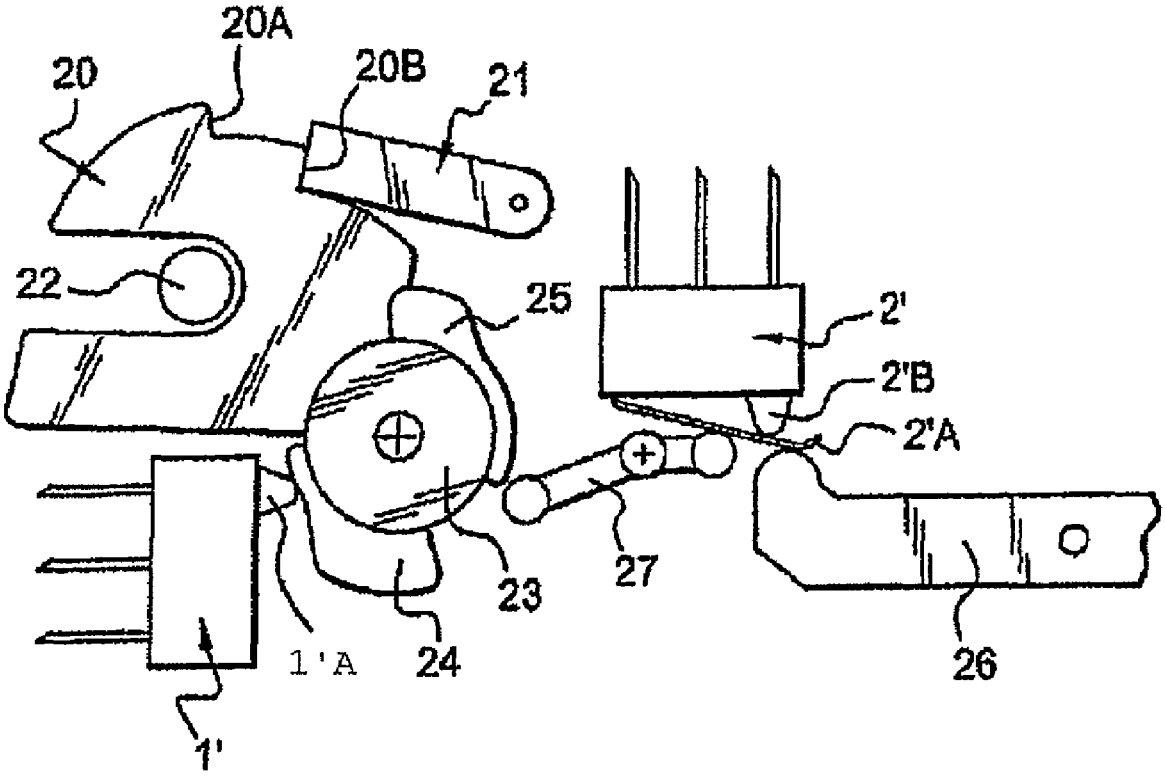

SYSTEM FOR DETECTION OF THE LOCKING STATES OF A MOTOR VEHICLE

The invention relates to a system of detecting states of a motor vehicle lock.

In motor vehicle opening locks with a motorized control device, it is necessary to detect by means of sensors the open/closed state of the opening and the action or the blocked/unblocked state of the lock. A certain number of sensors is used to do this.

In a known manner, three contact breakers may be used with two positions, open and closed, the first detecting the open/closed state of the opening, the second detecting the action of blocking at the barrel and the third detecting the action of unblocking at the barrel. These three contact breakers are each connected to an information wire connected to analysis means and to a common ground wire.

Patent document DE 42 22 018 describes such a detection system comprising two contact breakers each interacting with a profile of a cam that is integral with the barrel and that, when the barrel is moved, detects the blocked and unblocked states. To do this, one of the contact breakers or one of the cam profiles is movable. In such a system, a third contact breaker must be used to detect the open/closed state of the opening.

According to a variant, two contact breakers, in particular the contact breakers for detecting the blocking action and the unblocking action, may be replaced by a three-position switch. The system then comprises only two switching devices, but a three-position switch is relatively costly.

Known in the prior art is patent EP 1008711 which describes a detection system. This system comprises a contact breaker detecting the open/closed state of the opening and a switch detecting in one switched position the blocked state and in its other switched position the unblocked state. The information terminal of the contact breaker is connected to the information terminal of the switch so as to allow this contact breaker and this switch to be connected via two connecting wires to analysis means. This system therefore makes it possible to detect the open/closed state of the opening and the blocked/unblocked state and comprises a ground wire and two information wires connected to the analysis means.

In this system for controlling the blocked/unblocked state of a motorized lock, three states may be determined combining the state of the opening in question and the state of the lock, that is:

1. the open state of the opening when the lock is unblocked,
2. the closed state of the opening when the lock is blocked,
3. the closed state of the opening when the lock is unblocked.

This patent in no way makes it possible to obtain an item of information concerning the states of the barrel, that is the "neutral" state (no action/control of the barrel on the lock), the state of control of blocking the lock and the state of unblocking the lock.

The system of the invention intends to remedy the disadvantages of this prior art by offering a system capable of detecting the states of the barrel, which makes it possible to act on the blocking/unblocking of the locks of the other openings of the vehicle, and does not require mechanical connections between the barrel and the lock.

Such a system, although using only two sensors, requires the use of a switch with two connection information positions and the connection of the terminals of the contact breaker and the switch.

Also known in the prior art is patent FR 2778939, filed by the applicant, which does not constitute a system for processing detected information because it does not comprise any analysis means connected to the two contact breakers. Furthermore, it does not make it possible, like patent EP 1008711, to determine the state of the barrel.

The object of the invention is to provide a detection system also with two sensors but with a simpler structure and therefore more optimized in the matter of manufacture and cost while making it easier to analyze the information downstream.

More generally, the invention applies to the detection of other states of a lock of a motor vehicle opening. For example, the system according to the invention also makes it possible to detect the first catch or second catch positions of the lock, by detecting the position of the bolt of the lock.

To do this, the invention proposes a system for detecting at least the open state of an opening of a motor vehicle and two other states of the lock of this opening, called first and second state, comprising two switching devices associated with the opening and with the lock of which a contact breaker with a normally open or normally closed position detecting at least the open state of the opening, these two devices being connected to a ground cable, characterized in that this first contact breaker also detects said first state and is connected to a first information cable and in that the second switching device is also a contact breaker with a normally open or normally closed position also detecting two states, of which one is common with the states detected by the first contact breaker, and is connected to a second information cable, these two information cables being connected to analysis means.

"Contact breaker" means either a contactor or a contact breaker. Note that a contactor is a device that makes the electric circuit when a user presses on the control member while a contact breaker is a device that opens the electric circuit when a user presses on the control member.

One of the advantages of the present invention lies in the fact that the device according to the invention uses exclusively contact breakers and not switches. The contact breaker is a simpler technical solution, therefore more reliable and less costly than the switch solution which, it should be noted, consists of a component with three outputs, forming a contact breaker and a contactor.

Preferably, one of said contact breakers is provided with a movable blade capable, when it is pressed to a point at a distance from the contact of this contact breaker, of actuating this contact.

Such a contact breaker has the advantage of being able to be switched by pressing on several points of this blade. It therefore allows switching by two actuation elements, without posing a problem of space and of constraint of positioning of these actuation elements. The contact breaker is actuated by means of two separate mechanical actions which correspond to different kinematic chains and/or different states of the opening.

According to a first preferred embodiment of the invention, the lock being associated with a barrel, said first state is the unblocked state of said barrel and is detected by the corresponding action and the second contact breaker detects this unblocked state and the blocked state of said barrel, both detected by the corresponding action.

In this case, preferably, the first contact breaker is provided with a movable blade capable, when it is pressed to a point at a distance from the contact of this contact breaker, of actuating this contact.

Advantageously, the system comprises a pin sliding from a first position to a second position when the opening is opened and vice versa when the opening is closed and actuating said contact in its second position.

Advantageously, this system comprises a member integral in rotation with the barrel and supporting two cams, one directly actuating the contact of said second contact breaker when the barrel rotates following a blocking action and when the barrel is rotated following an unblocking action and the other moving a rotary lever when the barrel is rotated, following said unblocking action from an inactive position of this lever to an activated position in which this lever exerts said pressure on said blade.

According to a second preferred embodiment of the invention, a lock comprising a double-catch bolt interacting with a pawl and associated with an internal blocking lever, said first state is the position state of the bolt when the pawl is abutting the first catch of the latter and the second contact breaker also detects the open state of the opening and the second state which is the position state of the internal blocking lever.

In this case, preferably, the second contact breaker is provided with a movable blade capable, when it is pressed to at least one point at a distance from the contact of this contact breaker, of actuating this contact.

Advantageously, said pressure on said blade is exerted by the internal blocking lever in the blocked position.

Advantageously, the system comprises a member integral in rotation with the bolt and supporting two cams, one directly actuating the contact of said first contact breaker when the bolt is in the open position and when the bolt is in a position such that the pawl of the lock is abutting the first catch and the other moving a rotary lever when the bolt is rotated in the open position from an inactive position of this lever to an activated position in which this lever exerts said pressure on said blade.

The invention also relates to a lock of a motor vehicle opening fitted with a detection system as specified hereinabove.

The invention is described hereinafter in greater detail with the aid of figures representing only preferred embodiments of the invention.

FIGS. 2 to 5 and 7 are partial views of a motor vehicle lock fitted with a detection system according to this first embodiment of the invention.

FIG. 9 is a partial view of a motor vehicle lock fitted with a detection system according to this second embodiment of the invention.

FIGS. 1 to 5 and 7 represent a first embodiment of the invention.

Figure 1:
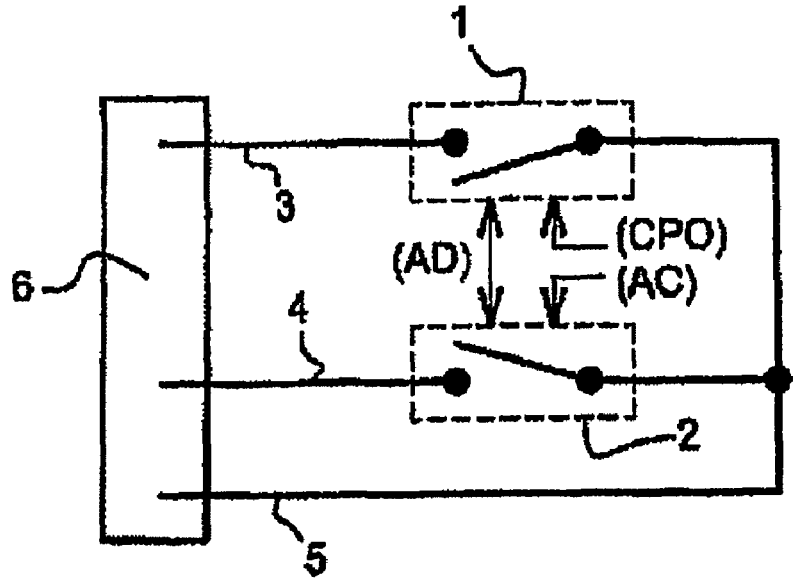
FIG. 1 is a representation of the electric circuit of a detection system according to the invention according to a first embodiment.

The system, as represented schematically in FIG. 1, comprises two switching devices 1, 2 associated with the opening and with the lock of which one contact breaker 1 with a position normally open or normally closed detecting the open/closed state CPO of the opening. This first contact breaker 1 also detects the unblocking action AD and is connected to a first information cable 3, and the second switching device is also a contact breaker 2 with a position normally open or normally closed detecting the blocking action AC and the unblocking action AD and is connected to a second information cable 4. These two contact breakers 1, 2 are connected to a common ground cable 5 and these three cables 3, 4, 5 are connected to analysis means 6.

According to a variant not shown, but entering into the scope of the invention, the detection of the blocking and unblocking actions may be inverted. More precisely, the first contact breaker 1 may detect the blocking action AC instead of the unblocking action AD.

The two contact breakers 1 and 2 are either normally open contact breakers or normally closed contact breakers.

Returning to the embodiment represented in FIG. 1 and supposing that these contact breakers are both normally open, if the information on the information output cables 3 and 4 is coded as follows:

F(3-5)=1 in the closed state of the connection between the information cable of the first contact breaker 1 and the ground cable 5 and F(3-5)=0 in the open state of the connection between the information cable of the first contact breaker 1 and the ground cable 5;

F(4-5)=1 in the closed state of the connection between the information cable of the second contact breaker 2 and the ground cable 5 and F(3-5)=0 in the open state of the connection between the information cable of the second contact breaker 2 and the ground cable 5;

the following coding information table is obtained:

TABLE 1

| Information F(3-5) | Information F(4-5) | State of the lock |
|---|---|---|
| 0 | 0 | Opening closed<br>No blocking or unblocking action<br>(barrel in neutral position) |
| 0 | 1 | Opening closed<br>Blocking action |
| 1 | 1 | Opening closed<br>Unblocking action |
| 1 | 0 | Opening open<br>No blocking or unblocking action<br>(barrel in neutral position) |
| 1 | 1 | Opening open<br>Blocking or unblocking action |

It should be noted that the main states to be detected on a lock are the first four states of the table. In a configuration for detecting these four essential states, the system according to the invention allows a direct detection of the state of the lock.

The fifth state of the table, that is "Opening open; Blocking or unblocking action" is usually optional. This state corresponds to an open opening and to an action performed on the barrel. In the case of detection of this state, the information (1, 1) is redundant for two states "Opening closed; Unblocking action" and "Opening open; Blocking or unblocking action" and an analysis of the foregoing information may be necessary for the detection of the state of the lock. If the foregoing information is (0, 0), it is the "Opening closed; Unblocking action" state. If the foregoing information is (1, 0), it is the "Opening open; Blocking or unblocking action" state.

As a variant, this "Opening open; Blocking or unblocking action" state may be undetected because it is of no use. Specifically, on certain motor vehicles, the barrel may not be operated when the opening is open.

If the contact breakers 1 and 2 are normally closed contact breakers or one normally open and the other normally closed, an equivalent logic is used.

A motor vehicle lock fitted with a detection system according to this first embodiment of the invention is represented in FIGS. 2 to 7 in different states.

These figures represent a member 10 integral in rotation with the barrel 16 of the lock and a sliding part 11 connected to the bolt of the lock. Said member is for example a wheel 10 and supports two cams 12 and 13. A sliding pin 14 interacts with the sliding part 11.

The first contact breaker 1 is provided with a flexible blade 1A capable, when it is pressed to a point at a distance from the contact 1B of this contact breaker, of actuating this contact. A rotary lever 15 has one end capable of being moved by the second cam 13 of the wheel 10 and its other end capable of coming to press the blade 1A of the contact breaker. This second cam 13 moves this rotary lever 15 when the barrel and therefore the wheel 10 is rotated, following an unblocking action, from an inactive position of this lever to an activated position in which this lever 15 exerts said pressure on said blade 1A.

The sliding pin 14, for its part, may pass from a first position to a second position when the opening is opened and conversely when the opening is closed and actuates the contact 1B of the first contact breaker 1 in the open position of the opening.

The second contact breaker 2 is placed on the stroke of the first cam 12 shaped with two active protruding portions, one corresponding to the blocked position and the other corresponding to the unblocked position, in order to actuate the contact 2A of this contact breaker 2 when the barrel 16 and therefore the wheel 10 is rotated following a blocking action and when the barrel 16 and therefore the wheel 10 is rotated following an unblocking action.

Figure 2:
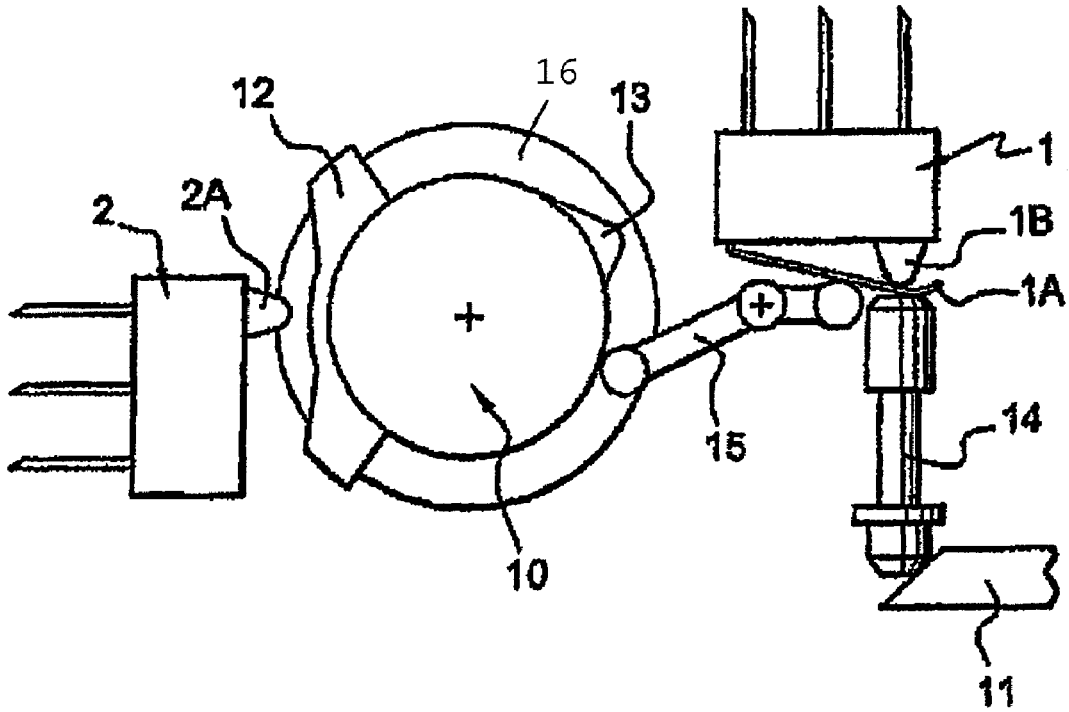

FIG. 2 illustrates the "Opening closed; No blocking or unblocking action" state. The pin 14 is in the inactive position, as is the lever 15. The contact 2A of the second contact breaker 2 is placed between the two protruding portions of the first cam 12 and not 30 switched. The barrel 16 is in the neutral position. The corresponding information is therefore (0, 0).

Figure 3:
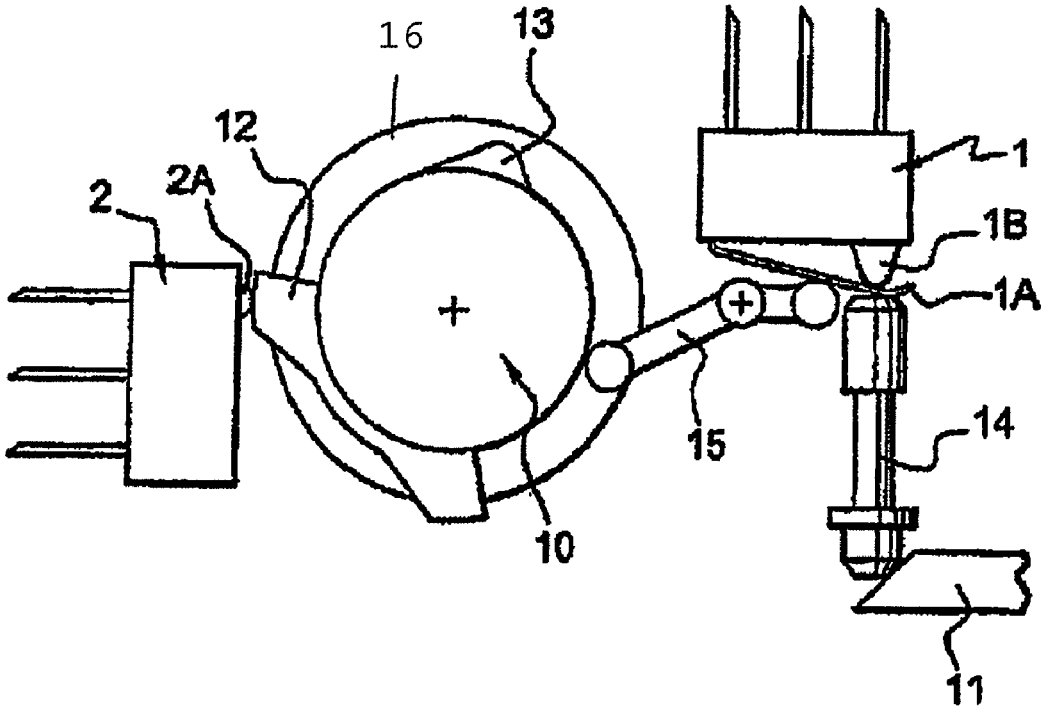

FIG. 3 illustrates the "Opening closed; Blocking action" state. The pin 14 is in the inactive position, as is the lever 15. The contact 2A of the second contact breaker 2 is switched by a protruding portion of the first cam 12. The corresponding information is therefore (0, 1).

Figure 4:
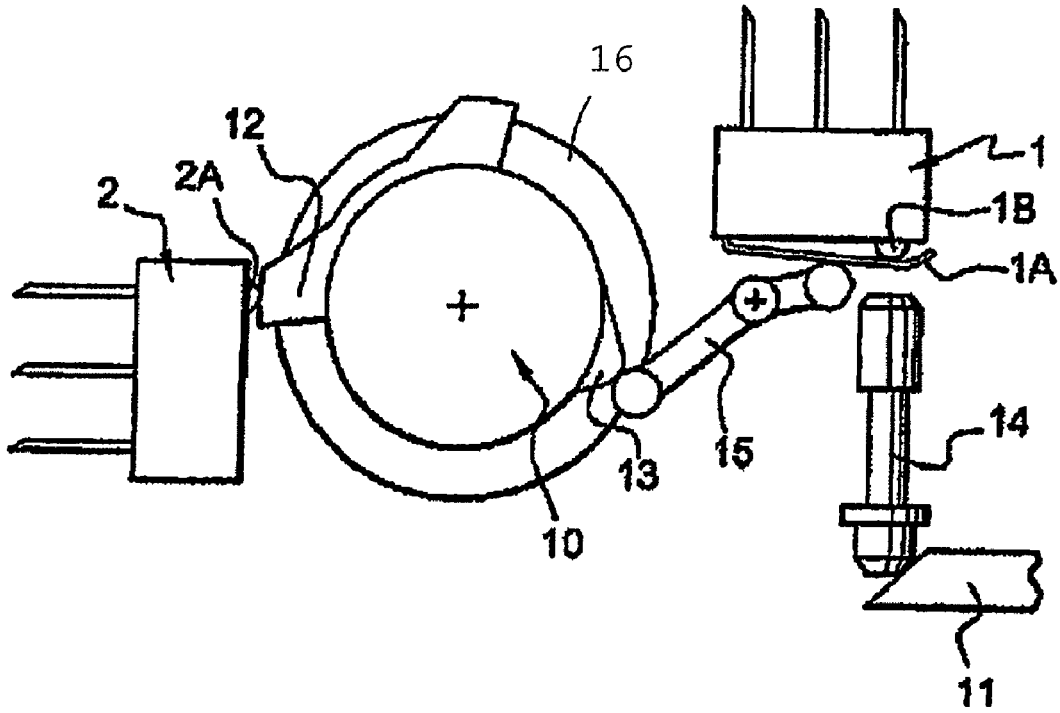

FIG. 4 illustrates the "Opening closed; Unblocking action" state. The pin 14 is in the inactive position. The lever 15 is acted upon by the second cam 13 and is moved to come to press the elastic blade 1A of the first contact breaker 1 which switches the corresponding contact 1B. The contact 2A of the second contact breaker 2 is switched by the other protruding portion of the first cam 12. The corresponding information is therefore (1, 1).

FIG. 5 illustrates the "Opening open; No blocking or unblocking action" state. The pin 14 is in the active position, pushed by the part 11, and comes to switch the contact 1B of the first contact breaker 1. The lever 15 is inactive. The contact 2A of the second contact breaker 2 is placed between the two protruding portions of the first cam 12 and not switched. The barrel is in the neutral position. The corresponding information is therefore (1, 0).

Figure 7:
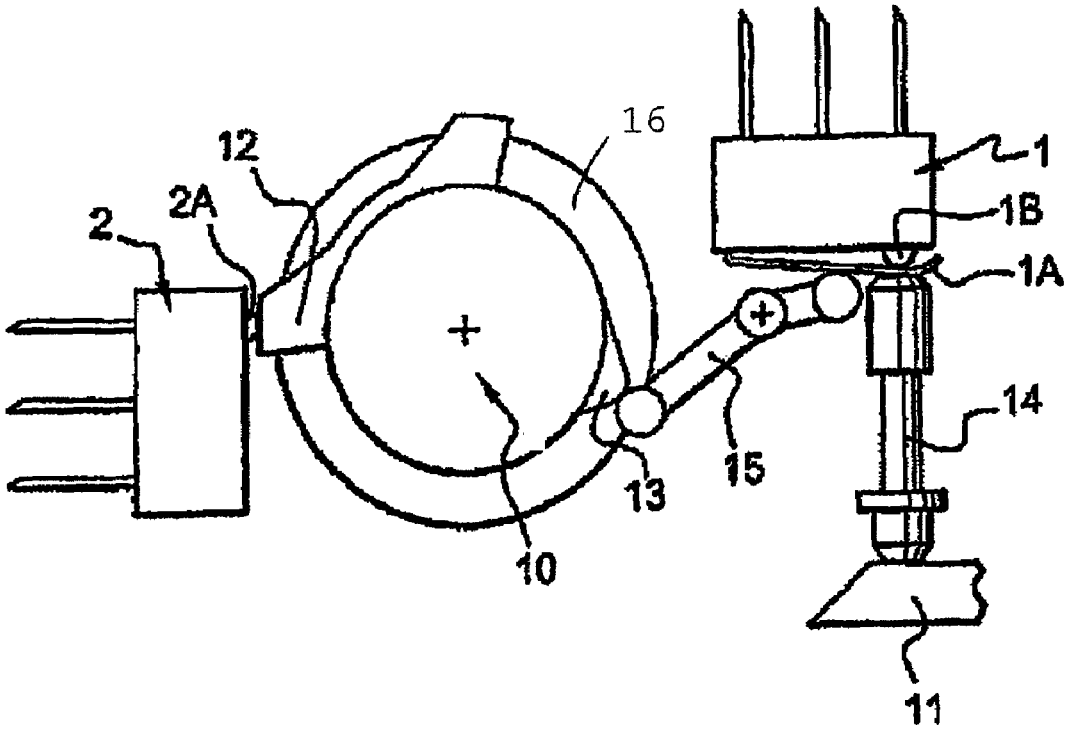

FIG. 7 illustrates the "Opening open; Unblocking action" state. The pin 14 is in the active position, pushed by the part 11, and comes to switch the contact 2B of the second contact breaker 2. The lever 15 is acted upon by the second cam 13 and is moved to come to press the elastic blade 1A of the first contact breaker 1 which switches the corresponding contact 1B. The contact 2A of the second contact breaker 2 is switched by the other protruding portion of the first cam 12. The corresponding information is therefore (1, 1).

Figure 8:
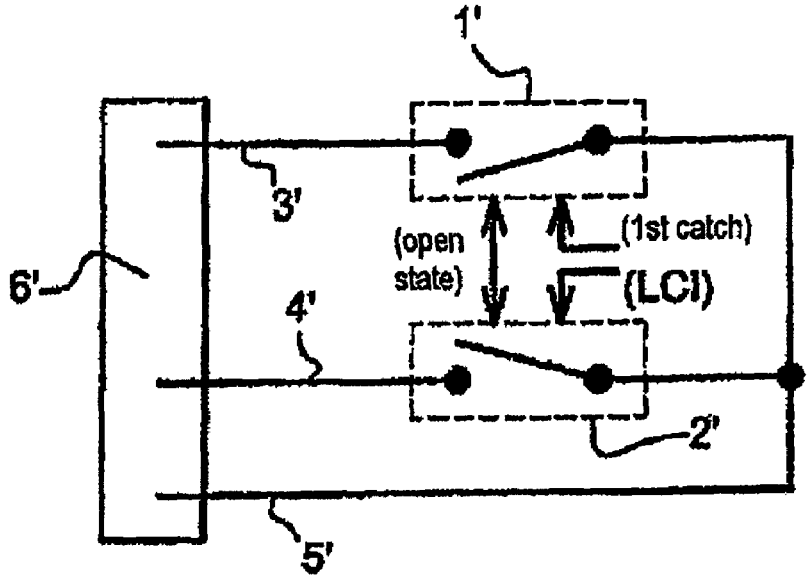
FIG. 8 is a representation of the electric circuit of a detection system according to the invention according to a second embodiment.

FIGS. 8 and 9 represent a second embodiment of the invention.

The object of this second embodiment is to detect the position of the lock, by means of the position of its bolt instead of that of its barrel.

The system comprises, as represented schematically in FIG. 8, two switching devices 1', 2' associated with the opening and with the lock of which a first contact breaker 1' with a position normally open or normally closed detecting the open/closed state of the opening. This first contact breaker 1' also detects the "first catch" state and is connected to a first information cable 3', and the other switching device is also a contact breaker 2' with a position normally open or normally closed detecting the open state and the internal blocked state LCI and is connected to an information cable 4'. These two contact breakers 1', 2' are connected to a common ground cable 5' and these three cables 3', 4', 5' are connected to analysis means 6'.

The two contact breakers 1' and 2' or either normally open contact breakers or normally closed contact breakers.

Supposing that these contact breakers are both normally open, if the information on the information output cables 3' and 4' is coded as follows:

F(3'-5')=1 in the closed state of the connection between the information cable of the first contact breaker 1' and the ground cable 5' and F(3'-5')=0 in the open state of the connection between the information cable of the first contact breaker 1' and the ground cable 5';

F(4'-5')=1 in the closed state of the connection between the information cable of the second contact breaker 2' and the ground cable 5' and F(3'-5')=0 in the open state of the connection between the information cable of the second contact breaker 2' and the ground cable 5';

the following coding information table is obtained:

TABLE 2

| Information F(3'-5') | Information F(4'-5') | State of the lock |
|---|---|---|
| 0 | 0 | Second catch unblocked |
| 0 | 1 | Second catch blocked |
| 1 | 0 | First catch unblocked |
| 1 | 1 | Open unblocked |
| 1 | 1 | Open blocked |
| 1 | 1 | First catch blocked |

It should be noted that the main states to be detected on a lock are the first four states of the table. In a configuration for detecting these four essential states, the system according to the invention allows a direct detection of the state of the lock.

The fifth and sixth states of the table, that is "Open blocked" and "First catch blocked" are usually optional. These two states may be treated in the same manner as the state (1, 1) corresponding to "Open unblocked" for example by interdiction of a centralized electric blocking when the opening is open or the lock is in the first catch position.

If the contact breakers 1' and 2' are normally closed contact breakers or one normally open and the other normally closed, an equivalent logic is used.

A motor vehicle lock fitted with a detection system according to this second embodiment of the invention is represented in FIG. 9.

This figure represents a lock bolt 20 and its rotary pawl 21. This bolt 20 is intended to interact with a strike 22 supported by the vehicle. A member 23 is integral in rotation with the bolt 20 of the lock and is for example a wheel 23. This wheel 23 supports two cams 24 and 25. The lock also comprises an internal rotary blocking lever 26.

The contact breaker 2', called the second contact breaker, is provided with a flexible blade 2'A capable, when it is pressed to a point at a distance from the contact 2'B of this contact breaker, of actuating this contact. A rotary lever 27 has one end capable of being moved by the second cam 25 of the wheel 23 and its other end capable of coming to press the blade 2'A of the contact breaker. This second cam 25 moves this rotary lever 27 when the bolt and therefore the wheel 23 is rotated, following an opening action of the opening, from an inactive position of this lever to an activated position in which this lever 27 exerts said pressure on said blade 1'A.

The internal rotary blocking lever 26, for its part, may travel from a first position to a second position when the lock is blocked and conversely when the lock is unblocked and actuates the contact 2'B of the second contact breaker 2' in the blocked position. More precisely, in the example shown, the internal blocking lever 26 also exerts a pressure on the elastic blade 2'A of the contact breaker 2', this time close to its free end.

The contact breaker 1', called the first contact breaker, is placed on the stroke of the first cam 24 designed with two active protruding portions, one corresponding to the first catch position and the other corresponding to the open position, in order to actuate the contact 2A of this contact breaker 2 when the bolt and therefore the wheel 23 is rotated following an action of closure of the first catch and when the bolt and therefore the wheel 23 is rotated following an opening action.

FIG. 9 illustrates the "Second catch unblocked" state. The pawl 21 is pressing on the second catch 20B of the bolt having traveled beyond the first catch 20A.

The lever 26 is in the unblocked position, inactive relative to the second contact breaker 2'. The rotary lever 27 is in the position that is deactivated by the second cam 2 and does not switch the second contact breaker 2'.

The contact 1'A of the first contact breaker 1' is placed outside the two active portions of the first cam 24 and not switched. The corresponding information is therefore (0, 0).

The invention claimed is:

1. A system for detecting at least an open state of an opening of a door of a motor vehicle and two other states of a lock of this opening, called a first state and a second state, comprising:

a first switching device associated with the opening of the door and the lock comprising a first contact breaker with a normally open or normally closed position, wherein the first switching device is configured to detect at least the open state of the door, wherein the first contact breaker detects the first state of the lock and is connected to a first information cable;

a second switching device associated with the opening of the door and the lock comprising a second contact breaker with a normally open or normally closed position, wherein the second contact breaker is configured to detect both the first and second state of the lock and is connected to a second information cable, wherein the first state detected by the second contact breaker is common with the first state detected by the first contact breaker, wherein the first and second information cables and the ground cable are connected to analysis means.

2. The system as claimed in claim 1, wherein one of said first and second contact breakers comprises a movable blade capable of actuating the one of the contact breakers, wherein actuating occurs when the movable blade is pressed to a point at a distance from a contact of the one of the contact breakers.

3. A system for detecting states of a lock associated with a barrel as claimed in claim 2, wherein said first state is the unblocked state of said barrel and is detected by a corresponding action, and wherein the second contact breaker detects the unblocked state and the blocked state of said barrel, both detected by the corresponding action.

4. The system as claimed in claim 1, wherein the system is configured to detect states of a lock associated with a barrel, wherein said first state is an unblocked state of said barrel and is detected by a corresponding action, and wherein the second contact breaker detects the unblocked state and the blocked state of said barrel, both detected by the corresponding action.

5. The system as claimed in claim 4, wherein the first contact breaker is provided with a movable blade capable of actuating a contact of the first contact breaker wherein the actuating occurs when the movable blade is pressed to a point at a distance from the contact.

6. The system as claimed in claim 5, further comprising a pin sliding from a first position to a second position when the opening is opened and vice versa when the opening is closed and actuating the contact in the second position.

7. The system as claimed in claim 5, further comprising a member integral in rotation with the barrel and supporting two cams, one directly actuating a contact of said second contact breaker when the barrel rotates following a blocking action and when the barrel is rotated following an unblocking action and the other moving a rotary lever when the barrel is rotated following said unblocking action from an inactive position of the lever to an activated position in which the lever exerts pressure on said movable blade.

8. The system as claimed in claim 6, further comprising a member integral in rotation with the barrel and supporting two cams, one directly actuating a contact of said second contact breaker when the barrel rotates following a blocking action and when the barrel is rotated following an unblocking action and the other moving a rotary lever when the barrel is rotated following said unblocking action from an inactive position of the lever to an activated position in which the lever exerts pressure on said movable blade.

9. The system as claimed in claim 1, further comprising:

a double-catch bolt interacting with a pawl and associated with an internal blocking lever, wherein said first state is a position state of the double-catch bolt when the pawl is abutting a first catch of the double-catch bolt, and wherein the second contact breaker detects the open state of the opening and the second state, which is a position state of the internal blocking lever.

10. The system as claimed in claim 9, wherein the second contact breaker comprises a movable blade capable of actuating the second contact breaker, wherein the actuating occurs when the movable blade is pressed to at least one point at a distance from a contact of the second contact breaker.

11. A lock of a motor vehicle opening fitted with a detection system as claimed in claim 9.

12. The system as claimed in claim 10, wherein the pressure on the blade is exerted by the internal locking lever in the locked position.

13. The system as claimed in claim 10, further comprising a member integral in rotation with the double-catch bolt and supporting two cams, one directly actuating the contact of said first contact breaker when the double-catch bolt is in the open position and when the double-catch bolt is in a position such that the pawl of the lock is abutting the first catch of the double-catch bolts and the other cam moving a rotary lever when the bolt is rotated in the open position from an inactive position of the rotary lever to an activated position in which the rotary lever exerts pressure on said movable blade.

14. The system as claimed in claim 12, further comprising a member integral in rotation with the double-catch bolt and supporting two cams, one directly actuating the contact of said first contact breaker when the double-catch bolt is in the open position and when the double-catch bolt is in a position such that the pawl of the lock is abutting the first catch of the double-catch bolt, and the other cam moving a rotary lever when the bolt is rotated in the open position from an inactive position of the rotary lever to an activated position in which the rotary lever exerts pressure on said movable blade.

15. A lock of a motor vehicle opening fitted with a detection system as claimed in claim 1.

* * * * *